United States Patent [19]

Tanaka et al.

[11] Patent Number: 4,804,586

[45] Date of Patent: Feb. 14, 1989

[54] COMPOSITE MATERIAL INCLUDING MATRIX METAL AND CLOSED LOOP CONFIGURATION REINFORCING FIBER COMPONENT MADE OF CARBON FIBERS WITH MODERATE YOUNG'S MODULUS, AND METHOD FOR MAKING THE SAME

[75] Inventors: Atsuo Tanaka; Tadashi Dohnomoto; Yoshiaki Kajikawa, all of Toyota, Japan

[73] Assignee: Toyota Jidosha Kabushiki Kaisha, Toyota, Japan

[21] Appl. No.: 38,833

[22] Filed: Apr. 15, 1987

[30] Foreign Application Priority Data

Apr. 16, 1986 [JP] Japan ..... 61-087659

[51] Int. Cl.[4] ..... C22C 1/09

[52] U.S. Cl. ..... 428/611; 428/614

[58] Field of Search ..... 428/614, 611, 634; 164/97; 123/193 P; 29/156.5 R

[56] References Cited

U.S. PATENT DOCUMENTS

| | | | |
|---|---|---|---|
| 4,216,682 | 8/1980 | Ban et al. | 164/97 |
| 4,452,865 | 6/1984 | Yamatsuta et al. | 428/614 |
| 4,498,219 | 2/1985 | Ban et al. | 123/193 P |
| 4,643,078 | 2/1987 | Ban | 123/193 P |
| 4,651,631 | 3/1987 | Avazov | 123/193 P |
| 4,662,326 | 5/1987 | Kohnert | 123/193 P |

FOREIGN PATENT DOCUMENTS

| | | | |
|---|---|---|---|
| 0137261 | 4/1985 | European Pat. Off. . | |
| 0162602 | 11/1985 | European Pat. Off. . | |
| 125263 | 7/1984 | Japan | 164/97 |
| 2081353A | 2/1982 | United Kingdom | 164/97 |

OTHER PUBLICATIONS

Levitt et al., Fabrication and Properties of Graphite Fiber Reinforced Magnesium, Metallurgical Transactions, vol. 3, Sep. 1972, pp. 2455–2459.

Kreider, K. G., Metallic Matrix Composites, Academic Press, NY, 1974, pp. 27, 322–329, 335–337.

*Primary Examiner*—John J. Zimmerman

*Attorney, Agent, or Firm*—Finnegan, Henderson, Farabow, Garrett & Dunner

[57] ABSTRACT

In a method for making a carbon fiber reinforced material, a mass of carbon fibers, disposed in a closed loop configuration, and initially having a Young's modulus which is between about 23 ton/mm$^2$ (23,000 kg/mm$^2$) and about 35 ton/mm$^2$ (35,000 kg/mm$^2$), is embedded within a mass of matrix metal by a process which involves the mass of matrix metal being heated at least to its melting point. A composite material made by such a method is also disclosed. Preferably, the carbon fibers, before being thus embedded in the mass of matrix metal, should have a Young's modulus which is between about 23 ton/mm$^2$ and about 30 ton/mm$^2$. By the Young's modulus of the carbon fibers thus being relatively moderate, the occurrence of faults such as cracks and fissures in the resulting composite material is obviated, and the resulting composite material has good strength and other characteristics.

4 Claims, 5 Drawing Sheets

COMPOSITE MATERIAL INCLUDING MATRIX METAL AND CLOSED LOOP CONFIGURATION REINFORCING FIBER COMPONENT MADE OF CARBON FIBERS WITH MODERATE YOUNG'S MODULUS, AND METHOD FOR MAKING THE SAME

BACKGROUND OF THE INVENTION

The present invention relates to a carbon fiber reinforced material and to a method for making it, and more particularly relates to such a carbon fiber reinforced material and to a method for making it, in which, particularly, reinforcing carbon fibers which are embedded in a matrix metal are oriented therein in a closed loop configuration.

In the prior art, the concept of utilizing carbon fibers as reinforcing material for a composite material, such as one utilizing carbon fibers embedded in a matrix of matrix metal, has been per se well known. Therefore, there have been proposed various types of carbon fiber reinforced material and methods for making the same. For example, in the specifications of Japanese Patent Applications Serial Nos. Sho. 60-59414 (1985), Sho. 60-49415 (1985), and Sho 60-59416 (1985), as well as in the specification of Japanese Patent Laying Open Publication Ser. No. Sho. 60-243239 (1985), none of which is it intended hereby to admit as prior art to the present patent application except to the extent in any case required by applicable law, and all of which are or relate to patent applications filed by an applicant the same as the entity assigned or owed a duty of assignment of the present patent application, there are disclosed such carbon fiber reinforced materials and various method for making them. Since carbon fibers have a relatively low coefficient of thermal expansion, and due to the relatively high rigidity and the relatively light weight of carbon fibers, such carbon fiber reinforced composite materials are endowed with various desirable mechanical properties. For example, in the particular case that such a carbon fiber reinforced composite material is utilized for making at least a part of a piston in an internal combustion engine, the thermal expansion of the piston is kept desirably low, and improved rigidity is ensured at the same time as precluding excessive thermal expansion of the bearing surfaces. And, further, it has been per se conceived of, and practiced, to orient such reinforcing carbon fibers, within the matrix material such as matrix metal in which they are embedded, in a closed loop configuration. Thus, various materials incorporating reinforcing carbon fibers oriented in various closed loop configurations such as annlar ring shaped configurations or cylindrical configurations or the like have already been proposed and practiced, as have processes for manufacturing them.

Now, in general the characteristics of carbon fibers vary quite significantly according to the disposition of the carbon atoms that make them up, i.e. according to the so called degree of graphitization and the so called degree of crystallization thereof. In general, it is per se known that the Young's modulus of carbon fibers increases according to increased graphitization of said carbon fibers, while on the other hand the moistenability of said carbon fibers with a typical matrix metal and their reactability with such a typical matrix metal are correspondingly decreased along with such increased graphitization thereof. In amnyu cases, such as those in which the matrix metal which it is desired to use for the composite material is a metal which has a comparatively high reactivity with carbon fibers such as aluminum alloy or magnesium alloy, it is desired to reduce the intensity of the reaction between the carbon fibers and the matrix metal. In such a case, therefore, carbon fibers which have a relatively high degree of graphitization, and which consequently have a relatively high value for their Young's modulus such as for example 40 ton/mm$^2$, (40,000 Kg/mm$^2$) are typically used.

There is however a problem with fiber reinforcement of a composite material with such a relatively high Young's modulus type of carbon fibers having a relatively high degree of graphitization, in that, when as is often desirable the reinforcing carbon fibers are oriented in a closed loop configuration such as an annular ring shaped configuration or a cylindrical configuration or the like as described above, and when as is generally the case the composite material is manufactured by the pressurized casting method or at least is manufactured by some method in which the matrix metal in the liquid phase is commingled with the carbon fibers and penetrates into the interstices between the carbon fibers which are oriented in said closed loop configuration, then the finished product is found to be very prone to cracking and fissurization of the reinforcing carbon fiber material, and it is very difficult in practice to ensure a good quality for the resulting composite material.

SUMMARY OF THE INVENTION

The inventors of the present invention have considered the various problems detailed above in the per se known case detailed above when the reinforcing closed loop configuration carbon fibers have a high Young's modulus such as one of around 40 ton/mm$^2$, and have made various experimental researches, some of which will be detailed later in this specification, to the end of elucidating the causes of such faults like cracking and fissurization of the reinforcing carbon fiber material. And the present inventors have determined that the root cause for such problems is that, during the casting (or other similar) process when the reinforcing closed loop configuration carbon fibers are being infiltrated with the molten matrix metal, said reinforcing carbon fibers have insufficient elasticity and deformability under stress. That is to say, a matrix material such as aluminum alloy or magnesium alloy generally has a higher coefficient of thermal expansion than such reinforcing carbon fibers, and thus, after the molten matrix metal has been infiltrated into the reinforcing carbon fiber mass and when said matrix metal is solidifying and thereafter is hardening and cooling, the matrix metal contracts much more than do the reinforcing carbon fibers. For this reason, the carbon fibers, most particularly when as specified above they are disposed in a closed loop configuration, suffer severe compression by the matrix metal as the temperature drops, and due to this compression shearing which is set up various faults such as cracks and fissures tend to develop. And, as will be detailed later in this specification, the inventors of the present invention experimented with using as the reinforcing material various masses of closed loop configuration carbon fibers which had a Young's modulus which was relatively low as compared to the above per se known reinforcing carbon fibers which had a high Young's modulus such as around 40 ton/mm$^2$, and discovered that the use of such reinforcing carbon fibers gave generally satisfactory and indeed outstanding results.

Accordingly, it is the primary object of the present invention to provide a closed loop configuration carbon fiber reinforced material, and a method for making it, which avoid the problems detailed above.

It is a further object of the present invention to provide such a closed loop configuration carbon fiber reinforced material, and a method for making it, which prevent the occurrence of faults such as cracks and fissures.

It is a further object of the present invention to provide such a closed loop configuration carbon fiber reinforced material, and a method for making it, which are relatively inexpensive.

It is a yet further object of the present invention to provide such a closed loop configuration carbon fiber reinforced material which has generally satisfactory mechanical properties, and to provide a method for making the same.

It is a yet further object of the present invention to provide such a closed loop configuration carbon fiber reinforced material which has good tensile strength, and to provide a method for making the same.

It is a yet further object of the present invention to provide such a closed loop configuration carbon fiber reinforced material which has good compression deformability, and to provide a method for making the same.

It is a yet further object of the present invention to provide such a closed loop configuration carbon fiber reinforced material in which the reinforcing carbon fiber material thereof has good moistenability with respect to the matrix metal thereof, and to provide a method for making the same.

It is a yet further object of the present invention to provide such a closed loop configuration carbon fiber reinforced material in which the reinforcing carbon fiber material thereof has good adherence with respect to the matrix metal thereof, and to provide a method for making the same.

According to the most general material aspect of the present invention, these and other objects are attained by a composite material comprising a mass of matrix metal and a mass of carbon fibers disposed in a closed loop configuration and embedded within said mass of matrix metal by a process which involves said mass of matrix metal being heated at least to its melting point; said carbon fibers, before being thus embedded in said mass of matrix metal, having a Young's modulus which is between about 23 ton/mm$^2$ (23,000 Kg/mm$^2$) and about 35 ton/mm$^2$; (35,000 Kg/mm$^2$); and, preferably, these and other objects may be attained more particularly by a composite material as specified above, wherein said carbon fibers, before being thus embedded in said mass of matrix metal, have a Young's modulus which is between about 23 ton/mm$^2$ and about 30 ton/mm$^2$. And, according to the most general method aspect of the present invention, these and other objects are attained by a method for making a composite material, wherein a mass of carbon fibers, disposed in a closed loop configuration, and initially having a Young's modulus which is between about 23 ton/mm$^2$ and about 35 ton/mm$^2$, is embedded within a mass of matrix metal by a process which involves said mass of matrix metal being heated at least to its melting point; and, preferably, these and other objects may be attained more particularly by a method for making a composite material as specified above, wherein said carbon fibers, before being thus embedded in said mass of matrix metal, have a Young's modulus which is between about 23 ton/mm$^2$ and about 30 ton/mm$^2$. According to an alternative method aspect of the present invention, these and other objects are attained by a method for making a composite material, wherein: (a) a mass of carbon fibers, disposed in a closed loop configuration, and having a Young's modulus which is between about 23 ton/mm$^2$ and about 35 ton/mm$^2$, is emplaced at an appropriate position within a casting mold; then subsequently (b) said casting mold is filled with a mass of matrix metal in the molten state which surrounds said carbon fiber mass; then further subsequently (c) said mass of molten matrix metal is pressurized to infiltrate between the fibers of said carbon fiber mass; and then yet further subsequently (d) said mass of molten matrix metal is allowed to solidify while being maintained in the pressurized state; and, preferably, these and other objects may be attained more particularly by a method for making a composite material as specified above, wherein said carbon fibers, before being thus emplaced within said casting mold, have a Young's modulus which is between about 23 ton/mm$^2$ and about 30 ton/mm$^2$. In any one of these cases, more particularly, the matrix metal may be aluminum alloy, or alternatively may be magnesium alloy.

According to such a carbon fiber reinforced composite material and a method for making it as variously specified above, since the carbon fibers which are used as the reinforcing component for the composite material are carbon fibers which have a relatively low Young's modulus which is between about 23 ton/mm$^2$ and about 35 ton/mm$^2$, and more particularly have an even lower Young's modulus which is between about 23 ton/mm$^2$ and about 30 ton/mm$^2$, and which are therefore carbon fibers which are comparatively more subject to elastic deformation than carbon fibers with relatively high Young's modulus, which as discussed above have been used as reinforcing material for conventional types of fiber reinforced composite materials, therefore, as will be clear from various researches which will be described in detail hereinafter which were conducted by the inventors of the present patent application, even when the reinforcing carbon fibers are subjected to relatively high stress such as the compression stress which is set up due to the contraction during solidification of the molten matrix metal—especially because the configuration of the long carbon fibers is a closed loop type configuration—at this time said reinforcing carbon fibers are able to contract as a result of their relatively high elastic deformability, in response to said compression stress. By this means, the problems detailed above with regard to the prior art are obviated, and it becomes possible to provide a closed loop configuration carbon fiber reinforced material, and a method for making it, which prevent the occurrence of faults such as cracks and fissures, and which furthermore can be practiced relatively inexpensively.

Further, according to the material and the method aspects of the present invention as detailed above, since the carbon fibers which are used as the reinforcing component for the composite material are carbon fibers which have a relatively low Young's modulus which is between about 23 ton/mm$^2$ and about 35 ton/mm$^2$, and more particularly have an even lower Young's modulus which is between about 23 ton/mm$^2$ and about 30 ton/mm$^2$, their moistenability with the molten matrix metal is significantly improved, as compared to the case of utilization of carbon fibers which have a relatively high degree of graphitization, and further an optimum reaction between said reinforcing carbon fibers and the molten matrix metal is engendered, thus providing improved adherence of said reinforcing carbon fibers with respect to the matrix metal. According to these facts, the mechanical properties of the resulting composite material, and in particular its strength (particularly its tensile strength) and its compression deformability, are enhanced.

According to a particular specialization of the present invention, as specified above, although the use, as the reinforcing component for the composite material, of carbon fibers which have a relatively low Young's modulus which is between about 23 ton/mm$^2$ and about 35 ton/mm$^2$ is in practice almost always sufficiently effective for preventing the occurence of faults such as cracks and fissures in the resulting composite material, nevertheless the above and other objects may more particularly be accomplished by such a carbon fiber reinforced material and a method for making it as first specified above, wherein more particularly the carbon fibers which are used as the reinforcing component for the composite material are carbon fibers which have an even relatively lower Young's modulus which is between about 23 ton/mm$^2$ and about 30 ton/mm$^2$. In this case, there will be further benefits attained, of the same types as those explained above, but even greater in degree and more certain in nature.

BRIEF DESCRIPTION OF THE DRAWINGS

The present invention will now be described with respect to the preferred embodiments of the product and of the method thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and spaces and so on in the various figures relating to one preferred embodiment, and like parts and spaces and so on in figures relating to different preferred embodiments; and:

DESCRIPTION OF THE PREFERRED EMBODIMENTS

The present invention will now be described with reference to the preferred embodiments thereof, and with reference to the figures.

The First Set of Preferred Embodiments

FIGS. 1 through 5 relate to the first set of preferred embodiments of the closed loop configuration carbon fiber reinforced material of the present invention, and to corresponding first preferred embodiments of the method of the present invention for making such a closed loop configuration carbon fiber reinforced material.

Figure 1:
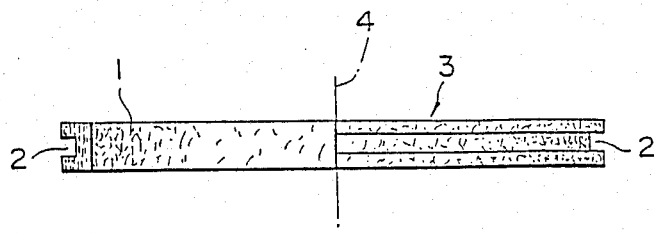
FIG. 1 is a partially cutaway side view of an annular preform made of alumina-silica short fiber material, for use for reinforcement of a piston for an internal combustion engine, which is formed with an external circumferential annular groove shape.

First, as shown in schematic partly sectional view in FIG. 1, a mass of alumina-silica fiber material of type "Kaowool" (this is a trade mark) manufactured by Isolite Babcock Taika K.K. was formed into the shape of a substantially circularly symmetric annular preform 3, of substantially square longitudinal cross section and with an annular groove 2 also of substantially square longitudinal cross section being inscribed around its outer circumference. The individual alumina-silica fibers 1 in this annular preform 3 were oriented substantially randomly in two dimensions, but were layered in the radial direction perpendicular to the central axis 4 of symmetry of the preform 3. And the overall fiber volume proportion of the alumina-silica fiber material in this annular preform 3 was approximately 8%.

Figure 2:
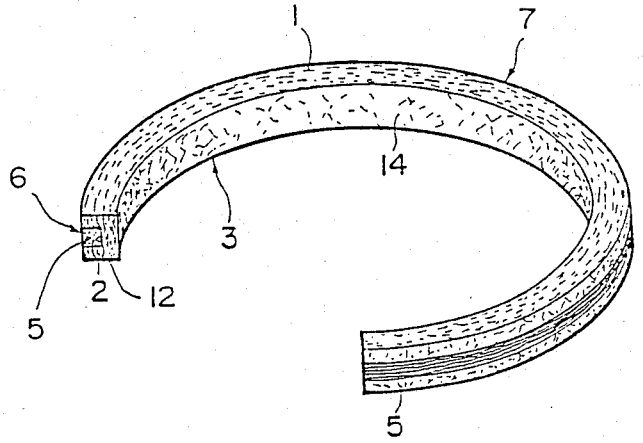
FIG. 2 is a schematic perspective view showing the FIG. 1 annular alumina-silica fiber preform with a closed loop configuration carbon fiber skein being fitted into its said circumferential annular groove shape, ready for being subjected to a casting process for producing a composite material in an appropriate position in a piston.

Next, as shown in schematic perspective view in FIG. 2, a skein of long carbon fibers 5 was wound in a circular or closed loop fashion into the circumferential groove 2 of this annular preform 3, so as substantially to fill up said circumferential groove 2. In this manner, the long carbon fibers 5 were disposed all around the annular preform 3 so as to constitute a carbon fiber mass 6 formed in a closed loop configuration, and overall about 60% to 70% of the volume of the combined preform mass, designated in the figures and referred to hereinafter as 7, was made up by this closed loop configuration formed carbon fiber skein mass 6. Thus, the annular preform 3 formed of the alumina-silica fibers 1 served as a bobbin or support structure for the closed loop configuration formed carbon fiber skein mass 6, the two together constituting the combined preform mass 7. And one of the planar annular defining surfaces of this combined preform mass 7 is designated in FIG. 2 as 12, while the internal cylindrical defining surface is designated as 14.

This process was performed in, altogether, fourteen cases, with the long carbon fibers utilized for making the closed loop configuration formed carbon fiber skein mass 6 being of the fourteen different types detailed in Table 1 below, and having Young's moduluses and tensile strengths as also laid out in that Table, the respective units in which said Young's moduluses and said tensile strengths are expressed in said Table being ton/mm$^2$ and kg/mm$^2$.

The carbon fibers designated as "A1", "A3", "A4", "A6", and "A7" were various types of carbon fibers marketed by Toray Co. Ltd. under the respective trade marks shown in Table 1. Further, in the case of the carbon fibers designated as "A2" and "A5", these were manufactured from quantities of the carbon fiber designated as "A1" by heat treatment, so as to bring the values for their Young's moduluses and the values for their tensile strengths to the values which are shown in that Table. The carbon fibers designated as "B1" through "B6" were various types of carbon fibers marketed by Toho Rayon Co. Ltd. under the respective trade marks shown in Table 1. The carbon fibers designated as "C1" and "C2" were various types of carbon fibers marketed by Sumitomo Chemical Hercules Co. Ltd. under the respective trade marks shown in Table 1. And the carbon fibers designated as "D1" and "D2" were various types of carbon fibers marketed by Union Carbide Corporation under the respective trade marks shown in Table 1.

TABLE 1

| Name | Number | Young's modulus | Tensile strength |
|---|---|---|---|
| T300 | A1 | 23 | 360 |
| — | A2 | 26 | 300 |
| T800 | A3 | 30 | 570 |
| M30 | A4 | 30 | 400 |
| — | A5 | 32 | 350 |
| M40 | A6 | 40 | 280 |
| M50 | A7 | 50 | 250 |
| ST3 | B1 | 24 | 440 |
| HM35 | B2 | 35 | 250 |
| HM45 | B3 | 45 | 220 |
| IM6 | C1 | 30 | 470 |
| HMU | C2 | 38.5 | 280 |
| P55 | D1 | 38.5 | 210 |
| P75 | D2 | 52.5 | 210 |

Figure 3:
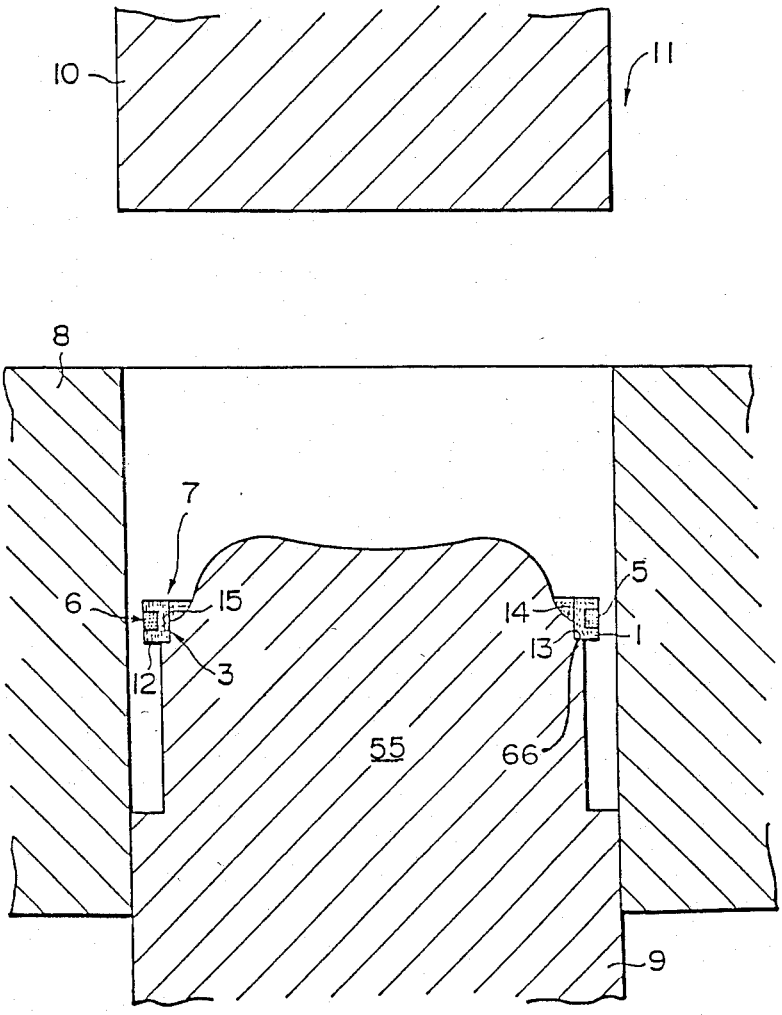
FIG. 3 is a longitudinal cross sectional view showing a three piece pressure casting mold as set up ready for forming by pressure casting a piston for an internal combustion engine, with the annular alumina-silica fiber preform of FIGS. 1 and 2 complete with the closed loop configuration carbon fiber skein of FIG. 2 fitted thereto being pressure fitted onto and over a step shape defined on a lower mold portion of said pressure casting mold.

Next, in each of the fourteen cases, as shown in longitudinal cross sectional view in FIG. 3, a casting mold 11 for casting a piston for an internal combustion engine was set up, as follows. This casting mold 11 comprised: a main mold body 8, which was formed as a block with a hollow cylindrical bore formed therein which was for defining the outer cylindrical surface of the piston which was to be formed; a lower mold portion 9, which was formed as a cylindrical plug which snugly fitted into the lower end (in the figure and in the actual setup also) of the main mold body 8, for defining the lower end surface of the piston which was to be formed, and which was further formed with a circularly symmetric upwardly protruding portion 55 on it upper surface for defining a piston cavity within said piston to be formed, said protruding portion 55 being formed with an annular step shape generally designated as 66 which was defined by a cylindrical wall portion 15 and an annular planar step portion 13; and an upper mold portion 10, which in this particular construction was formed as a simple cylindrical plug or piston shape, for defining the upper end surface of the piston which was to be formed. And, in the set up procedure, the lower mold portion 9 was fitted into the lower end of the bore of the main mold body 8 and was fixed there by means not particularly shown in the figures, and then, in each of the fourteen cases, the relevant above described one of the combined preeform masses 7, comprising the annular preform 3 formed of the aluminasilica fibers 1 with the closed loop configuration formed carbon fiber skein mass 6 wound into its circumferential groove 2, first was preheated up to a temperature of approximately 450° C., and then was tightly fitted over the aforesaid annular step shape 66 of said lower mold portion 9, with it slower side planar surface being abutted against the annular planar step portion 13 which defined said annular step shape 66, while its internal cylindrical defining surface 14 was squeezed tightly against the cylindrical wall portion 15 which defined said annular step shape 66. This position of the combined preform mass 7 on the protruding portion 55 of the lower mold portion 9 was stabilized by means of press fitting of said combined preform mass 7 thereonto.

Figure 4:
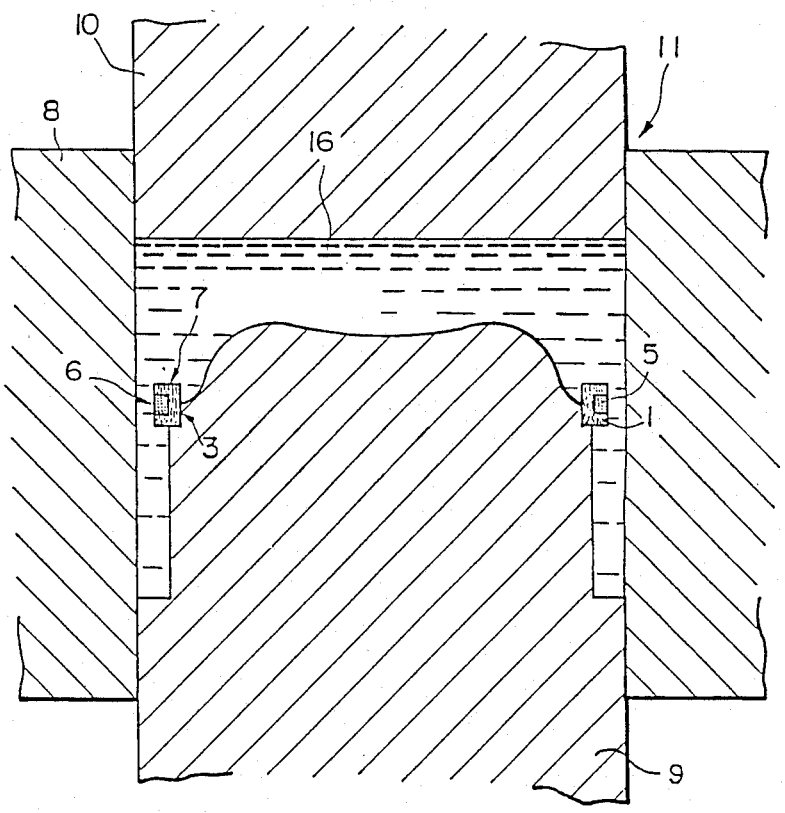
FIG. 4 is a longitudinal cross sectional view of said FIG. 3 casting mold with said silica fiber preform and said closed loop configuration carbon fiber skein fitted thereto, during the pressure casting process for said internal combustion engine piston when said casting mold is filled with aluminum alloy.

Next, as shown also in longitudinal cross sectional view in FIG. 4, a quantity 16 of molten aluminum alloy of JIS standard AC8A at a temperature of approximately 740° C. was poured into the casting mold 11, i.e. was poured into the portion of the cylindrical bore in the main mold body 8 which remained above the lower mold portion 9, thus surrounding the combined preform mass 7 fitted on the protruding portion 55 of said lower mold portion 9, and then the upper mold portion 10 was fitted into the upper end of said cylindrical bore in said main mold body 8 and was pressed strongly downwards by a means not particularly shown in the drawings, so that said upper mold portion 10 pressed against the free upper surface of said molten aluminum alloy mass 16 and pressurized said molten aluminum alloy mass 16 as a whole to a pressure of approximately 1000 kg/cm$^2$. And this pressurized condition was maintained while the molten aluminum alloy mass 16 cooled, and until said molten aluminum alloy mass 16 had completely solidified. After this complete solidification, the upper mold portion 10 and the lower mold portion 9 were removed from the main mold body 8, and the coarse piston preform thus formed was separated. In each of the fourteen cases, for the purposes of evaluation, instead of being further machined for actual use, this coarse piston preform was sectioned through the combined preform mass 7 including the closed loop configuration formed carbon fiber skein mass 6 embedded therein which had been so positioned by the process as explained above within said coarse piston preform as to fulfill the role of a carbon fiber reinforced component portion for the finished piston, if such had been finally produced. This sectioning process enabled the present inventors to examine the quality of said carbon fiber reinforced component portion by the use of a microscope.

The results of this examination in terms of the quality of the carbon fiber reinforced component portion of the resultant rough piston preform, in each of the fourteen cases, are shown in Table 2 below, along with the value (extracted from Table 1) for the Young's modulus of the carbon fibers which were used for the closed loop configuration formed carbon fiber skein mass 6 of the combined preform mass 7 in each case. In this Table: the sign "00" indicates that there were absolutely no faults such as fissures or cracks in the thus examined carbon fiber reinforced portion of the relevent rough piston preform; the sign "0" indicates that virtually no such faults (fissures or cracks) were present in said thus examined carbon fiber reinforced portion of said relevant rough piston preform; while the sign "X" indicates that such faults such as fissures or cracks were present to such an extent in said thus examined carbon fiber reinforced portion of said relevant piston preform as to reach an unacceptable level.

TABLE 2

| Number | Young's modulus | Quality |
|---|---|---|
| A1 | 23 | OO |
| A2 | 26 | OO |
| A3 | 30 | OO |
| A4 | 30 | OO |
| A5 | 32 | O |
| A6 | 40 | X |
| A7 | 50 | X |
| B1 | 24 | OO |
| B2 | 35 | O |
| B3 | 45 | X |
| C1 | 30 | OO |
| C2 | 38.5 | X |
| D1 | 38.5 | X |
| D2 | 52.5 | X |

From Table 2, it will be seen that it is possible in various cases to manufacture a composite material including a matrix metal and a reinforcing fiber component portion made of carbon fibers disposed in a closed loop configuration, satisfactorily without engendering any substantial amount of faults such as cracks or fissures in the reinforcing carbon fiber component portion, when the carbon fibers which are utilized have a Young's modulus which is between about 23 ton/mm$^2$ and about 35 ton/mm$^2$; and preferably, in order to obtain even better quality for said reinforcing carbon fiber component portion, said carbon fibers utilized should have a Young's modulus which is between about 23 ton/mm$^2$ and about 30 ton/mm$^2$. And these ranges for the desired Young's modulus of the closed loop configuration carbon fiber material are valid, substantially irrespective of the type of carbon fibers utilized, and substantially irrespective of their tensile strength.

Comparison Tests

Next, in order to investigate in greater detail the causes of the results described above, a series of comparison tests were performed, by manufacturing various composite materials which were similar to those detailed above, except that the reinforcing carbon fibers incorporated therein were not disposed in the closed loop configuration.

In detail, nine generally flat plat shaped samples of nine different composite materials were manufactured by a pressure casting method similar to that described above with respect to the first set of preferred embodiments of the present invention, using, as reinforcing long fiber material, samples of those of the long carbon fiber materials, described above and specified in Table 1, which were designated as "A1", "A3", "A4", "A6", "B1", "B2", "C1", "C2", and "D1". In each case, the volume proportion of the reinforcing long carbon fiber material was set to be between about 65% and about 70%, the matrix metal utilized was aluminum alloy of JIS standard AC8A, and the individual long fibers of the reinforcing long carbon fiber material were oriented substantially in one longitudinal direction. Each of these generally flat plate shaped composite material samples was of dimensions approximately 60 mm in length, approximately 10 mm in width, and approximately 2 mm in depth, and the carbon fibers were oriented along the 60 mm direction of said composite material samples.

Figure 5:
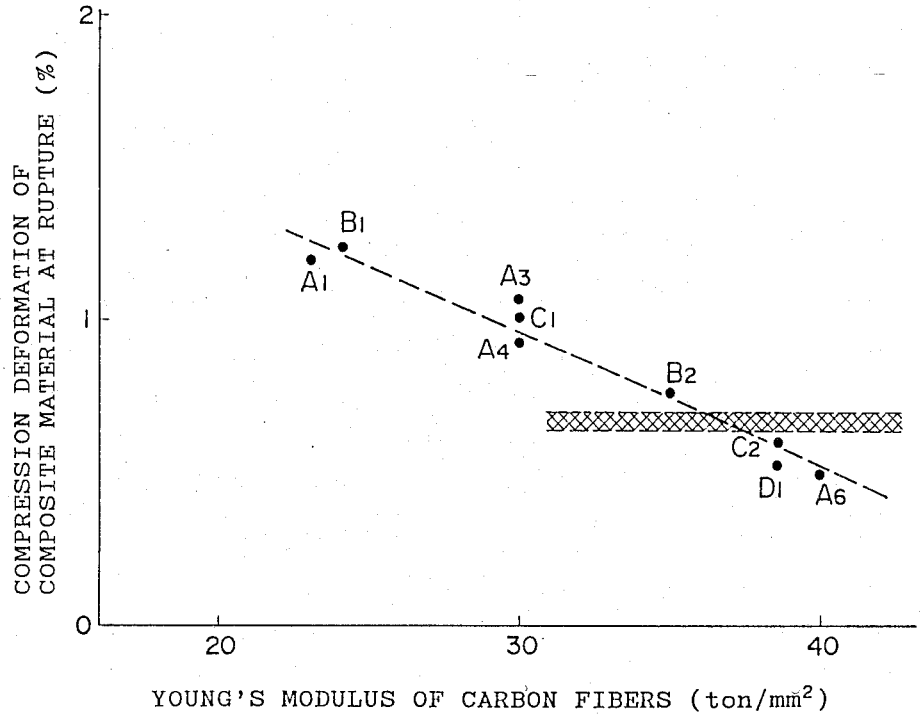
FIG. 5 is a graph relating to compression tests which were performed upon certain comparison composite material samples not according to the present invention, the reinforcing long carbon fibers of said comparison composite material samples not being oriented in the closed loop configuration but being oriented linearly, in which the Young's modulus in ton/mm$^2$ of the reinforcing carbon fibers is shown along the horizontal axis and the compression deformation in percent at rupture of said comparison composite material samples is shown along the vertical axis.

Next, compression tests were performed upon these nine composite material samples by compressing them in the longitudinal direction (along their 60 mm axes, parallel to their reinforcing long carbon fibers), in order to assess the amount of compression deformation in percent that was required in order to produce compression rupturing in said samples, i.e. the amount of compression deformation in percent that said samples could sustain before undergoing such compression rupturing. The results of these tests are presented in FIG. 5, which is a graph in which the Young's modulus in ton/mm$^2$ of the reinforcing carbon fibers used in the composite material samples is shown along the horizontal axis and the compression deformation in percent at rupture of said composite material samples is shown along the vertical axis. In FIG. 5, the area shown by cross hatching is the area in which it is estimated that the amount of compression deformation of the carbon fibers which is produced at the time of pressure casting falls.

From FIG. 5 it will be understood that, approximately, the compression deformability of such composite materials including as reinforcing fibers long carbon fiber material is inversely proportional to the Young's modulus of said reinforcing long carbon fibers, and it will be further understood that this finding is valid substantially irrespective of the tensile strength of said long carbon fibers; this is an unexpected result. It will also be understood that, when as the reinforcing fiber material there are utilized long carbon fibers with a compression deformability that is not sufficiently able to resist and suffer the deformation of the matrix metal and of the composite material as a whole, i.e. when long carbon fibers with a Young's modulus which is greater than about 35 ton/mm$^2$ are utilized, then substantial generation of faults such as cracks and fissures will almost inevitably occur. From the results of these compression tests, then, it will be apparent that the use as reinforcing fiber material for the composite material of long carbon fibers with a Young's modulus which is less than about 35 ton/mm$^2$ is desirable, in order to obtain a high quality composite material.

The Second Set of Preferred Embodiments

The second set of preferred embodiments of the closed loop configuration carbon fiber reinforced material of the present invention were made as follows, according to corresponding second preferred embodiments of the method according to the present invention for making such a closed loop configuration carbon fiber reinforced material.

Utilizing the same fourteen types of long carbon fiber material as detailed above in Table 1 with relation to the first set of preferred embodiments of the closed loop configuration carbon fiber reinforced material of the present invention, utilizing a matrix metal which, this time, was magnesium alloy of JIS standard MC2, and utilizing a manufacturing process which was substantially the same as that detailed above with respect to the first set of preferred embodiments except that the molten magnesium alloy was heated up to a temperature of approximately 700° C., fourteen composite materials were formed, and these materials were evaluated substantially as described above with respect to said first preferred embodiment set.

The results of these tests will not be set forth in detail in this specification, in view of the desirability of terseness of disclosure. Suffice it to say that, in the case that the Young's modulus of the long carbon fiber material which were used as reinforcing fiber material for the composite material was greater than about 35 ton/mm$^2$, various faults such as cracks and fissures were generated in the resulting composite material. On the other hand, in the case that the Young's modulus of said long carbon fiber reinforcing material for the composite material was greater than about 30 ton/mm$^2$ but was less than about 35 ton/mm$^2$, virtually no such faults such as cracks and fissures were generated in the resulting composite material. Further, in the case that the Young's modulus of said long carbon fiber reinforcing material for the composite material was greater than about 23 ton/mm$^2$ but was less than about 30 ton/mm$^2$, absolutely no such faults such as cracks and fissures were generated in the resulting composite material.

Therefore it becomes clear that, also in this case when a magnesium alloy was used as the matrix metal for forming the composite material, the use as reinforcing fiber material for said composite material of long carbon fibers with a Young's modulus which is in the range between about 23 ton/mm$^2$ and about 35 ton/mm$^2$ is desirable, in order to obtain a high quality composite material; and, further, the use as reinforcing fiber material for said composite material of long carbon fibers with a Young's modulus which is in the range between about 23 ton/mm$^2$ and about 30 ton/mm$^2$ is even more desirable. Otherwise, the same functions and advantages are available with this second set of preferred embodiments of the closed loop configuration carbon fiber reinforced material of the present invention, and with this second set of preferred embodiments of the method for making them, as were available with the first sets of preferred embodiments, and accordingly further detailed description thereof will be eschewed in the interests of brevity of explanation.

The Third Set of Preferred Embodiments

The third set of preferred embodiments of the closed loop configuration carbon fiber reinforced material of the present invention were made as follows, according to corresponding third preferred embodiments of the method according to the present invention for making such a closed loop configuration carbon fiber reinforced material.

Utilizing the same fourteen types of long carbon fiber material as detailed above in Table 1 with relation to the first set of preferred embodiments of the closed loop configuration carbon fiber reinforced material of this present invention, utilizing a matrix metal which, this time, was aluminum alloy of JIS standard AC1A, and utilizing a manufacturing process which will shortly be described, fourteen objects formed of long carbon fiber reinforced composite material were formed, and these objects formed from these materials were evaluated.

Figure 6:
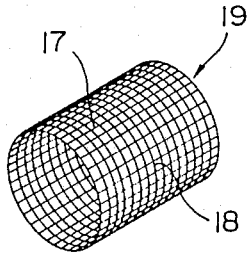
FIG. 6 is a schematic perspective view showing a tubular cylindrical closed loop configuration carbon fiber preform mass formed ready for being subjected to a casting process for producing a composite material in an appropriate position in a transmission casing preform.

In detail: first, in each case, as shown in schematic perspective view in FIG. 6, a quantity of the appropriate one of the long carbon fibers detailed in Table 1 above was formed into the shape of a hollow cylindrical or tubular preform generally designated as 19, with certain ones 17 of these long carbon fibers running generally in the longitudinal direction of said cylindrical tubular preform 19 substantially along its generators, and with other ones 18 of said long carbon fibers running generally in the circumferential direction of said cylindrical tubular preform 19 along its surface and substantially perpendicularly to its generators, thus being oriented in a closed loop configuration. This process was performed in, as before, altogether fourteen cases, with the long carbon fibers utilized for making the closed loop configuration formed carbon fiber cylindrical tubular preform 19 being of the fourteen different types detailed in Table 1 above, and having Young's moduluses and tensile strengths as also laid out in that Table.

Figure 7:
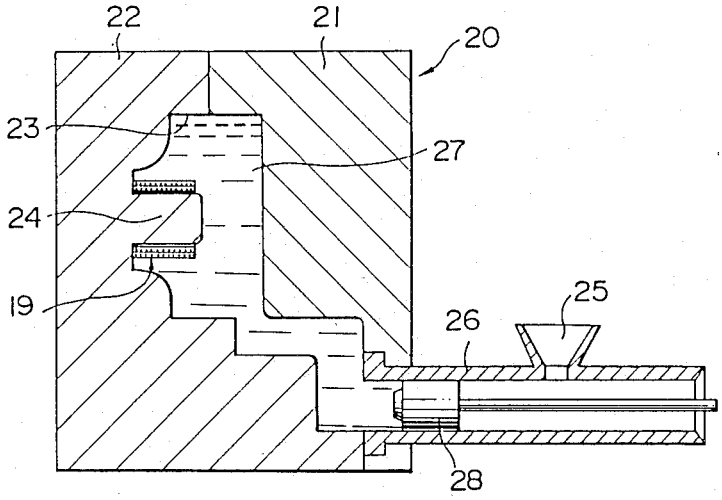
FIG. 7 is a longitudinal cross sectional view showing a two piece pressure casting mold as set up and during the act of forming by a pressure casting process a transmission casing preform for an automatic transmission for a vehicle, with the tubular cylindrical closed loop configuration carbon fiber preform of FIG. 6 being pressure fitted onto and over a cylindrical protuberance shape defined on a movable die portion of said pressure casting mold, and with said pressure casting mold being filled with aluminum alloy.

Next, in each of the fourteen cases, as shown in longitudinal cross sectional view in FIG. 7, a casting mold 20 for casting a preform for an transmission casing for an automatic transmission for a vehicle was set up, as follows. This casting mold 20 comprised: a fixed die portion 21, which was formed as a block with a suitably shaped cavity formed therein; a movable die portion 22, which was formed as a block with a suitably shaped cavity formed therein which cooperated with the cavity formed in the fixed die portion 21 to define the general shape of the transmission casing preform which was to be formed, and which was further formed with a generally cylindrical inwardly protruding portion 24 on its inner surface for defining a shaft receiving recess within said transmission casing preform to be formed; and a casting mold sleeve 26, which was formed as a tubular member fitted to the lower portion of the fixed die portion 21, with a funnel shape 25 being defined at its upper portion. And, in the set up procedure, in each of the fourteen cases, the relevant above described one of the cylindrical tubular preforms 19 first was preheated up to a temperature of approximately 400° C., and then was tightly fitted over the aforesaid cylindrical inwardly protruding portion 24 of said movable die portion 22, as shown in FIG. 7. This position of the cylindrical tubular preform 19 on the protruding portion 24 of the movable die portion 22 was stabilized by means of press fitting of said cylindrical tubular preform 19 thereunto. And then the movable die portion 22 was approached to and was pressed against the fixed die portion 21, so as to form a seal therebetween.

Next, as shown also in longitudinal cross sectional view in FIG. 7, a quantity 27 of molten aluminum alloy of JIS standard AC1A was filled into the casting mold 20 by being poured into the funnel shape 25 of the casting mold sleeve 26 and by then being forced into the mold cavity defined between the fixed die portion 21 and the movable die portion 22 of said casting mold 20 by a piston member 28 which was slidingly and cooperatively mounted in said sleeve 26, thus surrounding the cylindrical tubular preform 19 fitted on the protruding portion 24 of the movable die portion 22, and then the piston member 28 was further pressed strongly inwards into the sleeve 26 by a means not particularly shown in the drawings, so that said piston member 28 pressurized said molten aluminum alloy mass 27 as a whole to a pressure of approximately 500 kg/cm$^2$. And this pressurized condition was maintained while the molten aluminum alloy mass 27 cooled, and until said molten aluminum alloy mass 27 had completely solidified. After this complete solidification, the movable die portion 22 was removed away from the fixed die portion 21, and the coarse transmission casing preform thus formed was separated from these die members. In each of the fourteen cases, for the purposes of evaluation, instead of being further machined for actual use, this coarse transmission casing preform was sectioned through the cylindrical tubular preform 19 (which was a closed loop configuration formed carbon fiber reinforcing mass) which had been so positioned by the process as explained above within said coarse transmission casing preform as to fulfill the role of a carbon fiber reinforced component portion for the finished transmission casing preform, if such had been finally produced. This sectioning process, which was done in a plane perpendicular to the central axis of the cylindrical tubular preform 19, enabled the present inventors to examine the quality of said carbon fiber reinforced component portion by the use of a microscope. It was ascertained that the volume proportion of long carbon fibers in this carbon fiber reinforced component portion was approximately 50%.

The results of these tests will not be set forth in detail in this specification, in view of the desirability of terseness of disclosure. Suffice it to say that, in the case that the Young's modulus of the long carbon fiber material which were used as reinforcing fiber material for the composite material was greater than about 35 ton/mm$^2$, various faults such as cracks and fissures were generated in the resulting composite material. On the other hand, in the case that the Young's modulus of said long carbon fiber reinforcing material for the composite material was greater than about 30 ton/mm$^2$ but was less than about 35 ton/mm$^2$, virtually no such faults such as cracks and fissures were generated in the resulting composite material. Further, in the case that the Young's modulus of said long carbon fiber reinforcing material for the composite material was greater than about 23 ton/mm$^2$ but was less than about 30 ton/mm$^2$, absolutely no such faults such as cracks and fissures were generated in the resulting composite material.

Therefore it becomes clear that, also in this case when an aluminum alloy JIS AC1A was used as the matrix metal for forming the composite material, the use as reinforcing fiber material for said composite material of long carbon fibers with a Young's modulus which is in the range between about 23 ton/mm$^2$ and about 35 ton/mm$^2$ is desirable, in order to obtain a high quality composite material; and, further, the use as reinforcing fiber material for said composite material of long carbon fibers with a Young's modulus which is in the range between about 23 ton/mm$^2$ and about 30 ton/mm$^2$ is even more desirable. Otherwise, the same functions and advantages are available with this third set of preferred embodiments of the closed loop configuration carbon fiber reinforced material of the present invention, and with this third set of preferred embodiments of the method for making them, as were available with the first and the second sets of preferred embodiments, and accordingly further detailed description thereof will be refrained from in the interests of brevity of explanation.

Conclusion

This carbon fiber reinforced material and this method for making it, as compared to prior art concepts, only require that the carbon fibers to be used as the reinforcing component for the composite material should be carbon fibers having a relatively low Young's modulus which is between about 23 ton/mm$^2$ and about 35 ton/mm$^2$, and more particularly having an even lower Young's modulus which is between about 23 ton/mm$^2$ and about 30 ton/mm$^2$, and hence the implementation is relatively simple and is relatively low in cost. Thus, by this means, the problems detailed above with regard to the prior art are obviated, and it becomes possible to provide a closed loop configuration carbon fiber reinforced material, and a method for making it, which prevent the occurrence of faults such as cracks and fissures, and which furthermore can be practiced relatively inexpensively. Also, the moistenability of the reinforcing carbon fibers with the molten matrix metal is significantly improved, as compared to the case of utilization of carbon fibers which have a relatively high degree of graphitization, and further an optimum reaction between said reinforcing carbon fibers and the molten matrix metal is engendered, thus providing improved adherence of said reinforcing carbon fibers with respect to the matrix metal. According to these facts, the mechanical properties of the resulting composite material, and in particular its strength (particularly its tensile strength) and its compression deformability, are enchanced.

Although the present invention has been shown and described in terms of the preferred embodiments thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the scope of the accompanying claims, which follow.

What is claimed is:

1. A composite material comprising a mass of matrix metal, which composite material is of annular configuration having an outer surface, and a mass of carbon fibers each disposed circumferentially in a closed loop configuration through and embedded within said mass of matrix metal at said outer surface by a process which includes said mass of matrix metal being heated at least to its melting point; said carbon fibers, before being thus embedded in said mass of matrix metal, having a Young's modulus which is between about 23,000 kg/mm$^2$ and about 35,000 kg/mm$^2$.

2. A composite material according to claim 1, wherein said carbon fibers, before being thus embedded in said mass of matrix metal, have a Young's modulus which is between about 23,000 kg/mm$^2$ and about 30,000 Kg/mm$^2$.

3. A composite material according to claim 1 or claim 2, wherein said matrix metal is aluminum alloy.

4. A composite material according to claim 1 or claim 2, wherein said matrix metal is magnesium alloy.

* * * * *